US006085824A

United States Patent [19]

Cadorette

[11] Patent Number: 6,085,824

[45] Date of Patent: Jul. 11, 2000

[54] CONTROL CORD END SECURITY DEVICE

[75] Inventor: Mario Cadorette, Saint Therese, Canada

[73] Assignee: All-Teck Blinds, P.T.B. Inc., Montreal

[21] Appl. No.: 09/076,843

[22] Filed: May 13, 1998

[51] Int. Cl.[7] ..... E06B 9/38

[52] U.S. Cl. ..... 160/177 V; 160/321

[58] Field of Search ..... 160/320, 321, 160/344, 347, 176.1 V, 168.1 V, 178.1 V, 173 V, 177 V; 16/81, 194, 210, 211, 213, 215; 474/136, 84, 165, 140

[56] References Cited

U.S. PATENT DOCUMENTS

| | | | |
|---|---|---|---|
| 4,366,852 | 1/1983 | Holzer . | |
| 4,732,202 | 3/1988 | Anderson | 160/168.1 V |
| 5,125,447 | 6/1992 | Suggs | 160/320 |
| 5,553,650 | 9/1996 | Jelic | 160/178.1 R |
| 5,676,188 | 10/1997 | Cadorette . | |
| 5,752,558 | 5/1998 | Lin | 160/320 |

*Primary Examiner*—Blair M. Johnson
*Attorney, Agent, or Firm*—Sughrue, Mion, Zinn, Macpeak & Seas, PLLC

[57] ABSTRACT

A control cord end security device includes a base plate for mounting on a wall surface. A guide member is disposed on the base plate for slidably retaining an end loop of a cord of a window covering such as a blind. A cover plate is removably affixed to the base plate and covers the guide member and respective end loop of the cord. The guide member comprises a semicircular wall defining a generally U-shaped channel for slidably retaining and guiding a respective cord of the window covering. Preferably, the guide member includes a flange portion disposed distal the base plate. The flange portion abuts an interior surface of the cover plate such that an end loop of a respective control cord is prevented from binding between the guide member and the cover plate, even in the presence of slack in the control cord.

5 Claims, 4 Drawing Sheets

CONTROL CORD END SECURITY DEVICE

CROSS-REFERENCE TO RELATED APPLICATIONS

This application claims priority of Canadian Patent Application No. 2,226,228 filed Jan. 5, 1998.

MICROFICHE APPENDIX

Not Applicable

BACKGROUND OF THE INVENTION

This invention relates to a control cord security device. More specifically, the invention relates to a device for protecting the normally looped free end of a control cord, limiting access to such free end.

The looped bottom ends of control cords typically used on window coverings such as draperies, or venetian, roller or vertical control cords can constitute a safety hazard, particularly for small children. Such control cords often hang down to a short distance above the floor, and consequently are readily accessible to small children. If a child places the looped bottom end of a control cord around his or her neck, the result may be injury or strangulation. Moreover, since children have a tendency to put everything into their mouth, a child can choke on a control cord.

Many solutions to the problem outlined above have been proposed. commonly assigned U.S. Pat. No. 5,676,188, and Canadian Patent Application No. 2,153,034, the present inventor proposes a control cord security device comprising a housing defining a pair of channels. Each control cord runs within a respective one of the channels, and is retained therein and tensioned by a respective weight suspended from the end loop of the control cord. This arrangement allows the bottom portions of each of the control cords to be covered by the body, so that a child cannot injure himself on the control cord. Additionally, the control cords are independently tensioned by the weights, which keeps them taught between the top of the body and the headrail of the blind.

While effective, the above system suffers from the disadvantages that it has several components, which tend to increase the cost of the system. Additionally, since the body must accommodate two weights within respective tracks, the size of the body is comparatively large, and, where a blind only has one cord, one of the channels and weights will be unused.

SUMMARY OF THE INVENTION

An object of the present invention is to provide a simple low-cost control cord security device which is reliable and easy to install.

A further object of the present invention is to provide a control cord security device which is small in size and unobtrusive in appearance.

Accordingly, an aspect of the present invention provides a control cord end security device comprising a base plate mountable on a wall surface; a guide member disposed on the base plate and capable of slidably retaining an end loop of a cord of a blind; a cover plate capable of being removably affixed to the base plate and covering the guide member and respective end loop of the cord.

In an embodiment of the present invention, the guide member comprises a semicircular wall defining a generally U-shaped channel for slidably retaining and guiding a respective cord of the blind.

Preferably, the guide member comprises a flange portion disposed distal the base plate, the flange portion abutting an interior surface of the cover plate when the cover plate is affixed to the base plate such that an end loop of a respective control cord is substantially prevented from binding between the guide member and the cover plate, even in the presence of slack in the control cord.

In an embodiment of the invention, the semi-circular wall flares outwardly towards the flange portion and the base plate so that the U-shaped channel has a substantially U-shaped cross-section, whereby a control cord tends to run within the U-shaped channel substantially midway between the base plate and the flange portion, and friction between the control cord and the guide member is minimized.

In another embodiment of the invention, the semi-circular wall flares outwardly towards the flange portion, and meets the base plate substantially at a right-angle, whereby the U-shaped channel has an irregular cross-section.

The present invention can be used to secure a single control cord, or two or more control cords.

The present invention acts to secure the end loops of the control cord or cords to a wall, thereby preventing a child from becoming caught and possibly strangled by the cord, and further preventing a child from placing the control cord end into their mouth.

BRIEF DESCRIPTION OF THE DRAWINGS

Further features and advantages of the present invention will become apparent from the following detailed description, taken in combination with the appended drawings, in which.

It will be noted that throughout the drawings, like elements are identified by like reference numerals.

DETAILED DESCRIPTION

It will be noted that the following description of the present invention relates to a device designed particularly for use with a dual cord vertical blind. Of course, it will be appreciated that the device of the present invention can be used with any window covering (such as, for example, vertical blinds, venetian blinds, roller blinds or draperies) which is controlled by one or more continuous or looped cords.

Figure 1:
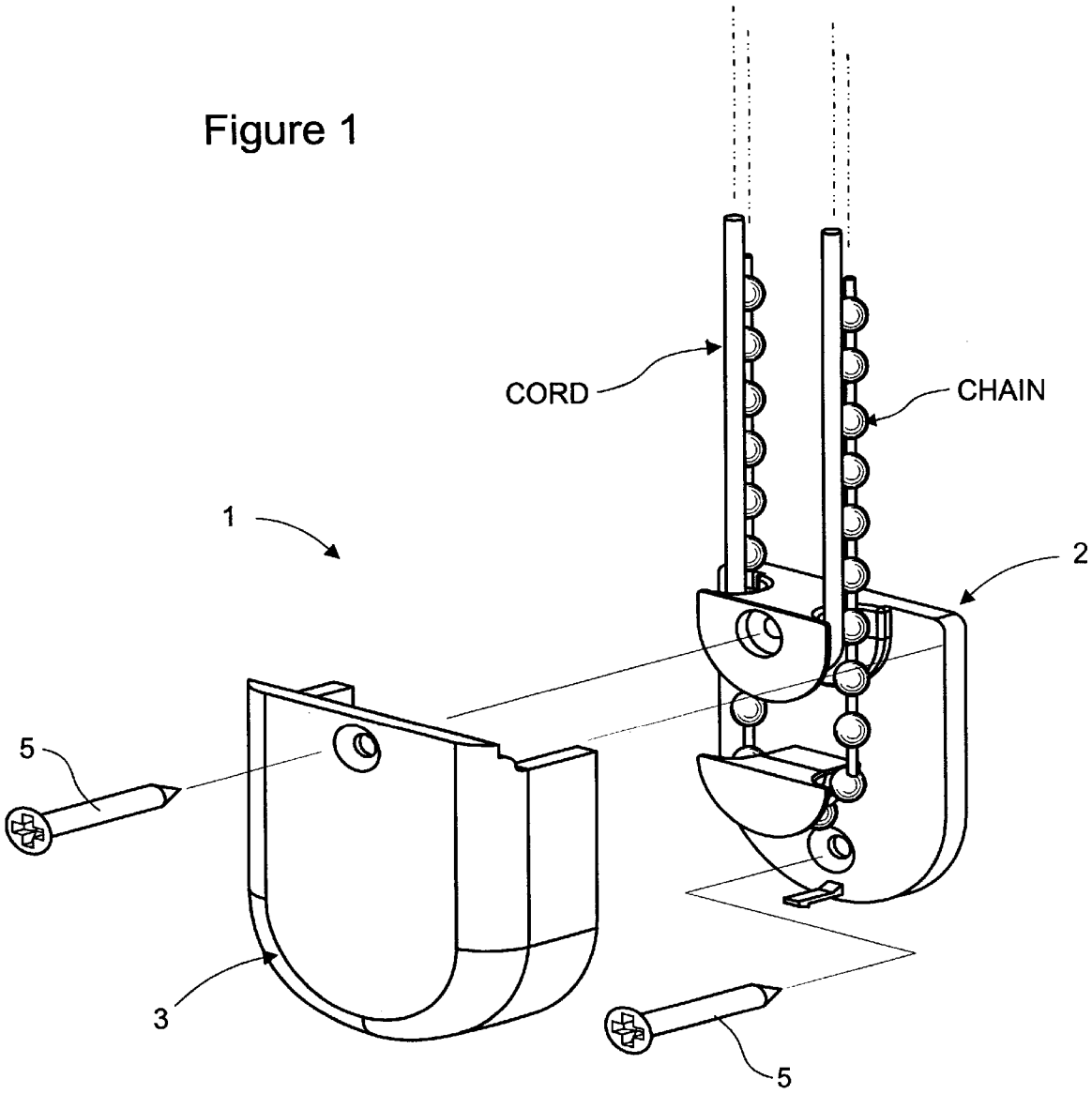
FIG. 1 is an exploded perspective view of a control cord end security device in accordance with an embodiment of the present invention.
Figure 2:
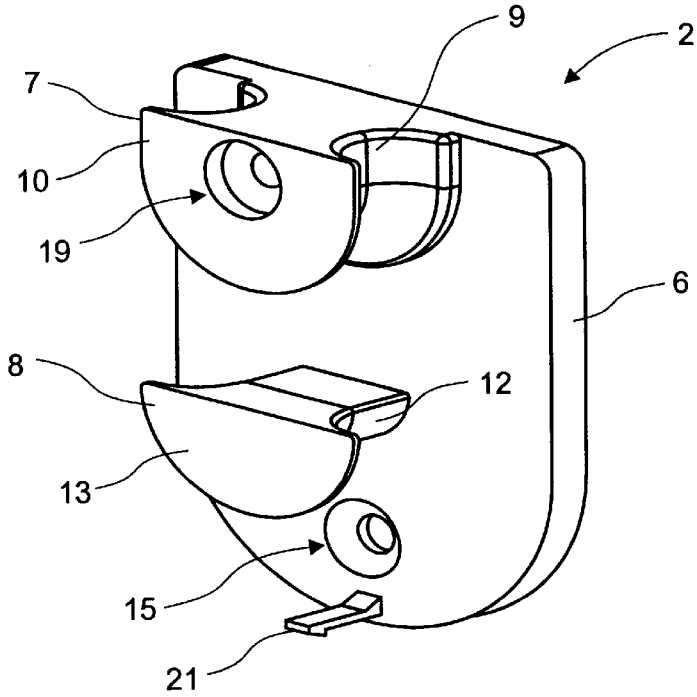
FIG. 2 is a perspective view of the base plate of the embodiment of FIG. 1.

Referring to FIG. 1, the control cord security device 1 of the present invention is intended for use with a blind, for example a vertical blind (not shown) of the type in which traversing and/or rotation of the vanes is controlled by a length of cord or chain which hangs down from the headrail of the blind to form a loop end. Often one control function of the blind, for example rotation of the vanes, is accomplished using a chain, while the other control function, for example traversing of the vanes, is accomplished using a cord.

Referring to FIGS. 1–4, the device 1 generally comprises a base 2 and a cover plate 3 which can conveniently be secured to each other, and mounted to a wall 4, by means of suitable fasteners, such as, for example, screws 5. The base 2 includes a mounting plate 6, and at least one guide member for slidably retaining an end loop of a blind control cord or chain. In the illustrated embodiment, the device 1 is provided with a cord guide member 7 and a chain guide member 8, so that the device 1 can conveniently accommodate a cord and a chain. Conveniently, the mounting plate 6 and guide members 7, 8 are moulded as a single piece, and composed of a suitable plastic material (such as, for example, acetal) having desirable properties of strength, hardness and low friction coefficient.

The cord guide member 7 includes a generally semi-circular wall 9 and a flange portion 10 distal to the mounting plate 6, so that the flange portion 10, semi-circular wall 9, and mounting plate 6 cooperate to define a channel 11 for retaining and guiding a respective control cord. As shown best in FIGS. 2 and 4, in the cord guide member 7, the semi-circular wall 9 flares outwardly toward both the flange portion 10 and the mounting plate 6 so that the channel 11 has a semi-circular or U-shaped cross-section (see FIG. 4).

Similarly, the chain guide member 8 includes a generally semi-circular wall 12 and a flange portion 13 distal to the mounting plate 6, so that the flange portion 13, semi-circular wall 12, and mounting plate 6 cooperate to define a channel 14 for retaining and guiding a respective chain. As shown best in FIGS. 2 and 4, in the chain guide member 8, the semi-circular wall 12 flares outwardly toward the flange portion 13, and meets the mounting plate 6 at approximately right-angles, thereby giving the channel 14 an irregular shape (see FIG. 4).

In general, either of the illustrated channel shapes can be used equally for either or both of the cord and chain guide members 7, 8. However, the U-shaped channel cross-section illustrated on the cord guide 7 tends to guide a cord to run approximately midway between the base plate and the flange portion 10. By holding the cord away from the base plate 6 and flange portion 10, friction tends to be minimized. Thus the U-shaped cross section of cord guide member 7 is particularly suitable for use with fabric or string cords. Metallic or plastic control chains, on the other hand, tend to slide easily on the plastic material of the base 2, and thus the irregularly shaped channel 14 of the chain guide member 8 can be used to advantage, by allowing the chain to naturally find a path of least interference with the control cord. The slightly higher friction expected with the irregularly shaped channel cross-section (due to contact between the chain and the base plate 6) raises no difficulties because of the lower friction coefficient between the chain and the material of the base 2.

The mounting plate 6 conveniently includes a mounting hole 15 by which the base 2 can be fastened to a wall using a suitable fastener, for example, a screw 5. Thus in use, the base 2 can be fastened at a suitable location on a wall 4, and then the end loops of the blind control cord and chain can be placed in respective channels 11 and 14 of the cord and chain guide members 7 and 8. If desired, the lengths of the control cord and chain can be suitably adjusted to reduce any slack between the device 1 and the headrail of the blind.

Figure 3:
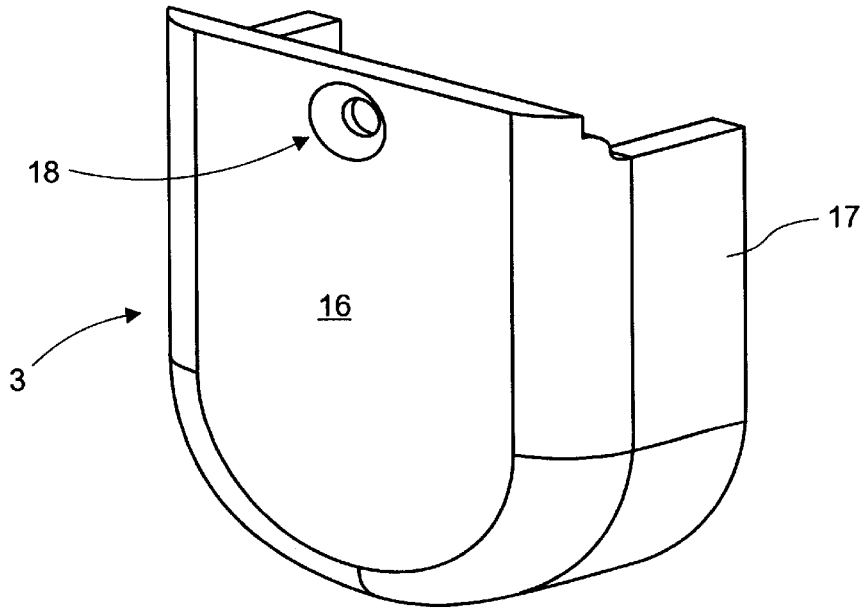
FIG. 3 is a perspective view of the cover plate of the embodiment of FIG. 1.

Referring now to FIGS. 1 and 3, the cover plate 3 is designed to provide a protective and visually attractive cover for the base 2 and the end loops of the control cord and chain. The cover plate 3 comprises a front face 16 which generally conforms to the shape of the mounting plate 6 of the base 2, and a wall 17 extending around the sides and lower portion of the front face 16. Conveniently, the height of the wall 17 is substantially equal to that of the guide members 7 and 8, so that, when the cover plate 3 is fitted onto the base 2, the top surfaces of the guide members 7, 8 will abut the inner surface of the front face 16 (see FIG. 5), and the wall 17 will extend to the mounting plate 6 of the base 2 so as to form an effectively continuous enclosure around the guides 7. The wall 17 of the cover plate 3 does not extend around the upper edge of the front face 16, so that the upper end of the device 1 will be open to permit free passage of the control cords.

Conveniently, the cover plate 3 includes a mounting hole 18 located near the upper edge of the front face 16. The mounting hole 18 corresponds to a matching through hole 19 extending through the cord guide 7, to permit securely fastening the cover plate 3 to the base 2 (and a wall 4) using a suitable fastener, for example, a screw 5. Advantageously, the cover plate 3 also includes a detent 20 proximal its lower end, for cooperative engagement with a lug or tab 21 formed on the base 2, so that the lower end of the cover plate 3 will not drift out of position with respect to the base 2.

Figure 4:
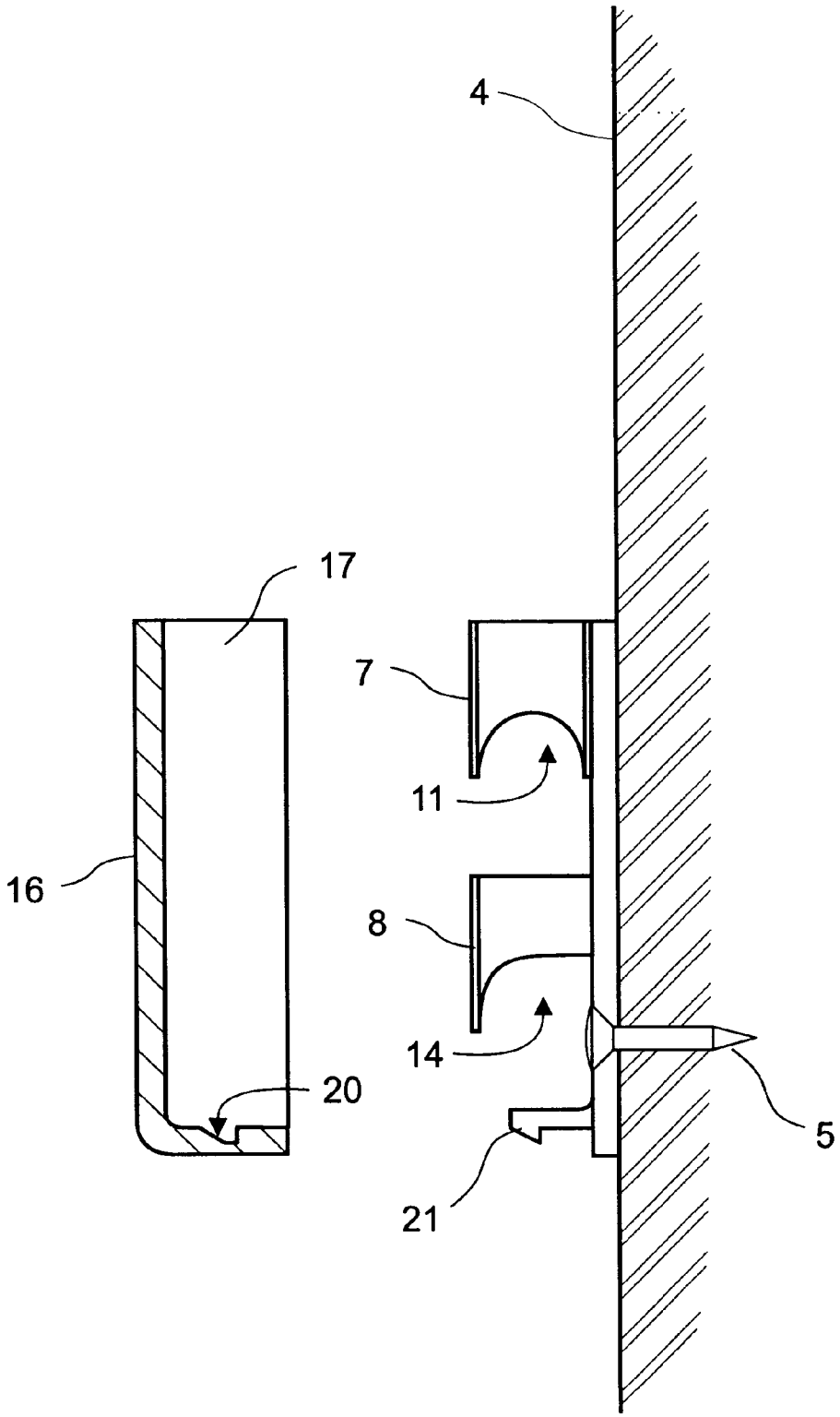
FIG. 4 is a partially cross-sectional side view of the embodiment of FIG. 1, in which the base is shown secured to a wall.
Figure 5:
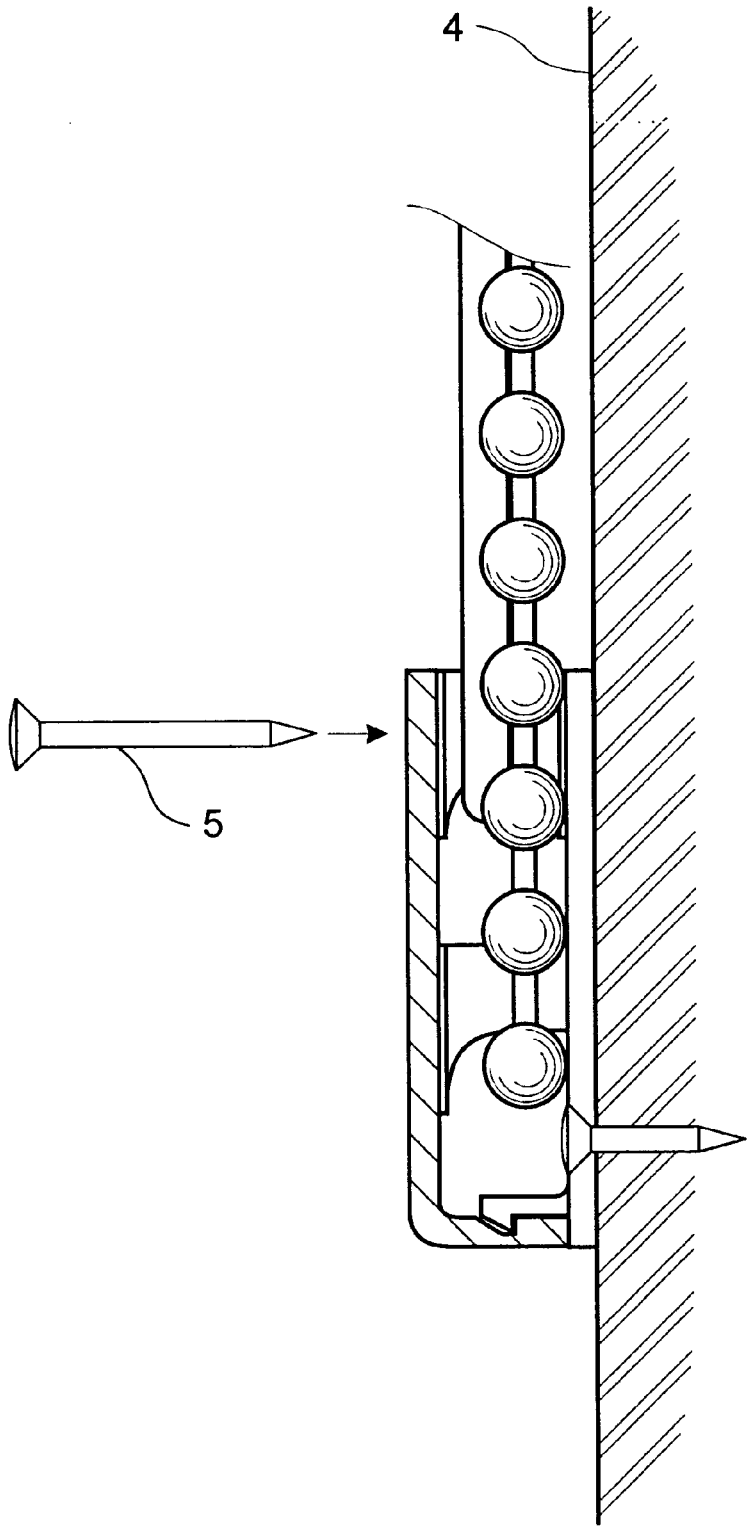
FIG. 5 is a partially cross-sectional side view of the embodiment of FIG. 1, in which the control cords and cover plate are shown in assembled condition.

Referring now particularly to FIGS. 4 and 5, when the device 1 is installed on a wall 4, the guide members 7, 8 abut against the inner surface of the front face 16 of the cover plate 3, and the control cord and chain run in the channels 11 and 14 of the guide members 7 and 8. The flange portions 10 and 13 of the guide members 7 and 8 ensure that the control cord and chain are held away from the cover plate 3, and thus will not become jammed between the guide members 7 and 8 and the inner surface of the cover plate 3, even if there is a substantial amount of slack in the cords.

The present invention has been described by way of an embodiment designed to accommodate a fabric or string cord, and a chain. However, it will be apparent that the described embodiment may be varied without departing from the intended scope of the invention. For example, a device could be constructed having a pair of cord guides, the resulting device being particularly suitable for use with blinds having two fabric or string cords. Conversely, a device could be constructed having a pair of chain guides, the resulting device being particularly suitable for use with blinds having two chains. While the above description contemplates a conventional metallic ball-chain, it will be seen that other types of chains may equally be used, including (without limitation) chains formed of spherical plastic beads fastened at intervals along the length of a fabric or string cord. Thus it will be seen that the above described embodiment is intended to be illustrative of the present invention rather than being limitative.

I claim:

1. A control cord end security device for a blind having first and second control cords, the control cord end security device comprising:

(a) a base plate (6) for fixedly mounting on a wall surface;

(b) a first guide member (7) rigidly disposed on the base plate, the first guide member including a respective first channel (11) for slidably guiding the first control cord, the first channel having a semicircular axis and a substantially curved U-shaped cross-section and a width adapted to be significantly greater than a diameter of the first control cord;

(c) a second guide member (8) rigidly disposed on the base plate substantially in line with the first guide member, the second guide member including a respective second channel (14) for rslidably guiding the second control cord, the second channel having a semicircular axis and a substantially U-shaped cross-section wherein one vertical half of said U-shaped cross-section is curved and the other vertical half thereof is angular and a width adapted to be significantly greater than a diameter of the second control cord; and (d) a cover plate (3) capable of being removably affixed to the base plate and covering the first and second guide members and adapted to cover the respective end loops of the first and second control cords.

2. A control cord end security device as defined in claim 1, wherein each of the first and second guide members comprise a respective semicircular wall and a flange portion disposed distal the base plate, the first channel being defined by the base plate and the flange portion and semicircular wall of the first guide member, and the second channel being defined by the base plate and the flange portion and semicircular wall of the second guide member.

3. A control cord end security device as defined in claim 2, wherein the flange portions of both the first and second guide members abut an interior surface of the cover plate when the cover plate is affixed to the base plate, such that the end loops of the first and second control cords would be substantially prevented from binding between the first and second guide members and the cover plate, even in the presence of slack in the first and/or second control cords.

4. A control cord end security device as defined in claim 3, wherein the substantially curved U-shaped cross section of the first guide member flares outwardly towards both the respective flange portion and the base plate so that the first channel has said substantially curved U-shaped cross-section, whereby the control cord is adapted to run within the first channel substantially midway between the base plate and the flange portion.

5. A control cord end security device as defined in claim 3, wherein the substantially curved U-shaped cross section of the second guide member flares outwardly towards the respective flange portion, and meets the base plate substantially at a right-angle, such that the second channel has a non-symetrical cross-section and the second control cord is adapted to find a path between the base plate and the flange portion of the second guide member which minimizes interference with the first control cord.

* * * * *